United States Patent [19]

Sodder, Jr. et al.

[11] 4,314,615

[45] Feb. 9, 1982

[54] SELF-PROPELLED DRILLING HEAD

[75] Inventors: George Sodder, Jr., 607 4th Ave., Montgomery, W. Va. 25136; Oliver E. Palmer, Montgomery, W. Va.

[73] Assignee: George Sodder, Jr., Alloy, W. Va.

[21] Appl. No.: 165,844

[22] Filed: May 28, 1980

[51] Int. Cl.[3] ..... E21B 4/02

[52] U.S. Cl. ..... 175/94; 175/95; 175/106; 175/107

[58] Field of Search ..... 175/94, 95, 99, 93, 175/107, 106, 164; 299/31

[56] References Cited

U.S. PATENT DOCUMENTS

| | | | |
|---|---|---|---|
| 2,201,862 | 5/1940 | Heisterkamp | 285/55 |
| 2,359,952 | 10/1944 | Welger | 285/55 |
| 2,519,847 | 8/1950 | Neely | 285/367 X |
| 2,619,325 | 11/1952 | Arutunoff | 175/107 |
| 2,779,996 | 2/1957 | Tanis | 285/365 X |
| 2,998,984 | 9/1961 | Gressel | 285/55 |
| 3,144,264 | 8/1964 | Lewis et al. | 285/367 |
| 3,235,291 | 2/1966 | Jacoby | 285/55 |
| 3,323,552 | 6/1967 | Whitehead,Jr. | 285/55 X |
| 3,406,991 | 10/1968 | Decker, Jr. et al. | 285/408 |
| 3,551,006 | 12/1970 | James | 285/55 X |
| 3,640,573 | 2/1972 | Safar | 299/31 |
| 3,742,590 | 7/1973 | Douglas | 285/55 X |
| 3,773,121 | 11/1973 | Ikeda | 175/95 |
| 3,825,079 | 7/1974 | Heilheckr | 175/104 |
| 3,876,252 | 4/1975 | Cilles | 285/302 |
| 4,014,574 | 3/1977 | Todd | 299/1 |

FOREIGN PATENT DOCUMENTS

| | | | |
|---|---|---|---|
| 598864 | 10/1959 | Italy | 285/365 |
| 820884 | 9/1959 | United Kingdom | 285/55 |
| 987126 | 3/1965 | United Kingdom | 285/55 |

*Primary Examiner*—William F. Pate, III

*Attorney, Agent, or Firm*—Burns, Doane, Swecker & Mathis

[57] ABSTRACT

A self-propelled drilling head comprises a base section including gripper shoes mounted for extension and retraction to selectively grip the wall of a hole being drilled. A first actuator is provided for extending and retracting the gripper shoes. A drilling section is mounted on the base for reciprocation relative thereto. A second actuator is provided for urging the drilling section downwardly relative to the base section when the gripper shoes are extended. A cutter bit is mounted at a lower end of the drilling section. A third actuator is provided for rotating the cutter bit and comprises a first hydraulic motor having a first output shaft. A second hydraulic motor is spaced below and laterally offset from the first hydraulic motor and has a second output shaft extending parallel to the first output shaft. A driven gear is mounted at the end of each output shaft. A drive transmitting gear mechanism is meshingly engaged on opposite sides by the driven gears. A first conduit supplies pressurized hydraulic fluid to the first and second motors. A second conduit conducts hydraulic fluid from the first and second motors. A power transmitting mechanism operably connects the drive transmitting gear to the cutter bit to rotate the latter.

16 Claims, 13 Drawing Figures

Fig. 2
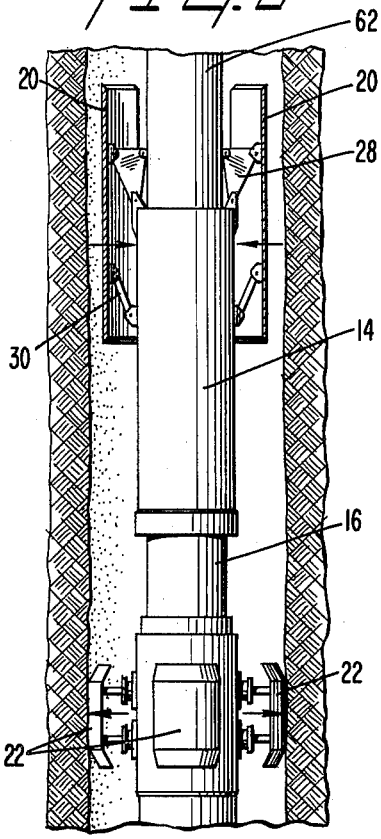
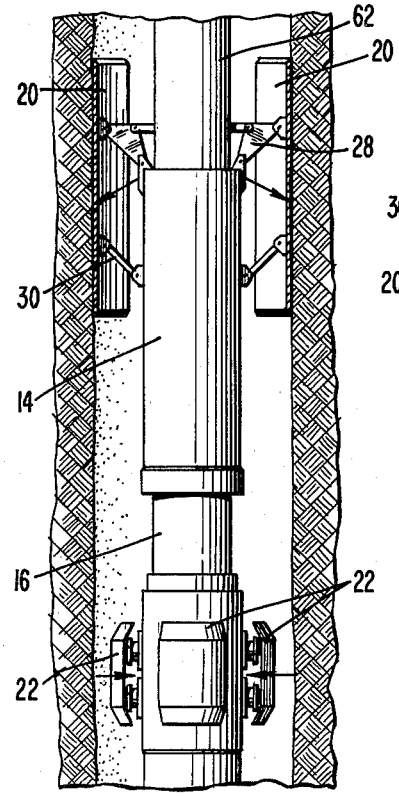
Fig. 3
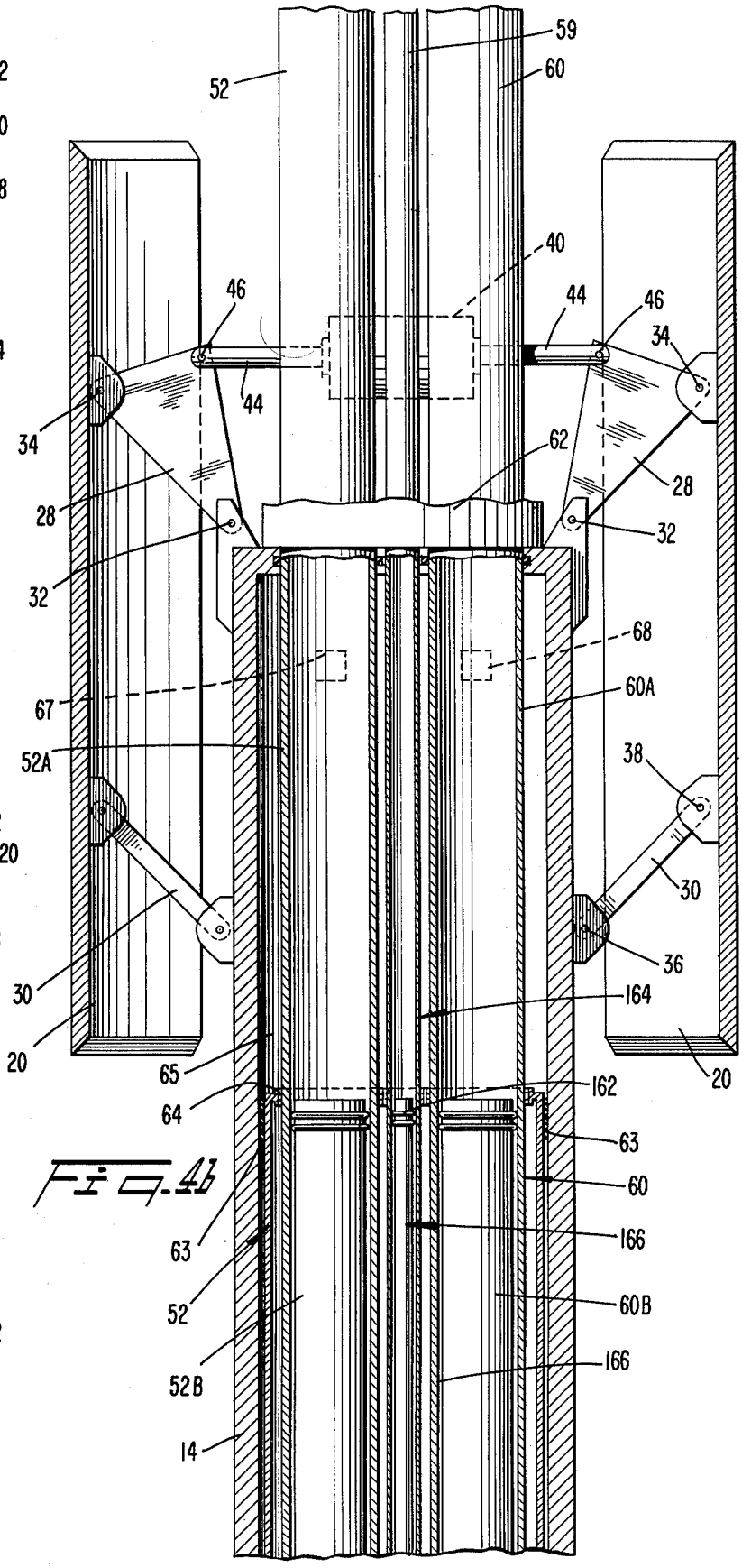
Fig. 4b

SELF-PROPELLED DRILLING HEAD

BACKGROUND AND OBJECTS OF THE INVENTION

The present invention relates to a drill for use in oil and gas drilling operations.

Drills have been proposed for gas and oil drilling which comprise multi-sectioned drill strings extending from the ground surface and carrying a cutter bit at the lower end. Rotary drive forces are applied to the drill string at the ground surface and are transmitted along the drill string to rotate the cutter bit. Not only are relatively large expenditures of energy required to rotate the entire drill string, but it is necessary to raise and uncouple every section of drill string in order to periodically replace the cutter bit. Furthermore, in the event that a break occurs along the length of the drill string, it is very difficult, if not impossible, to retrieve the string.

It has been heretofore proposed to eliminate the need for a drill string by utilizing a self-propelled cutter head which drills into the ground by means of a cutter head driven by a power plant carried by the head. The cutter head may comprise a plurality of telescoping sections, each carrying extensible/retractible shoes for engaging the wall of the hole being drilled. In this manner, one of the telescoping sections can be held fixed while the other section extends or retracts, and vice-versa, to enable the cutter head to "walk" down the hole in order to power the cutter bit. The power plant powers the cutter bit and is supplied with energy from the surface, such as electrical power or pressurized fluid, for example. Examples of such self-propelled heads are disclosed in U.S. Pat. No. 2,473,537 issued June 21, 1949; U.S. Pat. No. 2,643,087 issued June 23, 1953; U.S. Pat. No. 3,173,501 issued Mar. 16, 1965; U.S. Pat. No. 3,185,225 issued May 25, 1965; U.S. Pat. No. 3,232,362 issued Feb. 1, 1966; U.S. Pat. No. 3,407,887 issued Oct. 29, 1968; U.S. Pat. No. 3,882,946 issued May 13, 1975; U.S. Pat. No. 4,060,141 issued Nov. 29, 1977; and U.S. Pat. No. 4,143,722 issued Mar. 13, 1979.

Among the difficulties connected with the utilization of such self-propelled cutting heads is the need to dispose a practicable high-energy power plant within the limited amount of space available on the cutter head. Various proposals in this area involve the use of a drive mechanism disposed coaxially within the head, such as large turbine, a large hydraulic motor, or a group of series-connected electric motors, for example. While electrical power is simpler to supply than other forms of energy, it presents a serious heat dissipation problem within the drilling head. Fluid-actuated mechanisms such as turbines and hydraulic motors require that provision be made for supplying and withdrawing a continuous flow of pressurized fluid, thereby complicating the efforts to simplify and streamline the apparatus.

The use of a large coaxial fluid actuated mechanism maximizes the cross-sectional dimension of the drilling head, thereby further hindering streamlining efforts and, in the case of turbines, complicating the ability to conduct the spent hydraulic fluid upwardly from the bottom of the turbine.

It is, therefore, an object of the present invention to minimize or obviate problems of the type discussed above.

Another object of the invention is to provide a self-propelled drilling head which is of minimal cross-sectional dimension.

It is an additional object of the invention to provide a powerful space-saving drive mechanism for the cutter bit.

It is yet another object of the invention to provide an efficient drive train for transferring power efficiently and smoothly from the drive motors to the cutter bit.

It is a further object of the invention to provide a self-propelled drilling head of the step-down type which employs hydraulic fluid and effectively supplies and returns hydraulic fluid through the head by conduits which occupy minimal space.

A further object of the invention is to provide a self-propelled cutter head in which the components are safely shielded within rigid housings.

SUMMARY OF THE INVENTION

These objects are achieved by the present invention which relates to a self-propelled drilling head. The drilling head comprises a base section including gripper shoes mounted for extension and retraction to selectively grip the wall of a hole being drilled. A first actuator is provided for extending and retracting the gripper shoes. A drilling section is mounted on the base for reciprocation relative thereto. A second actuator is provided for urging the drilling section downwardly relative to the base section when the gripper shoes are extended. A cutter bit is mounted at a lower end of the drilling section. A third actuator is provided for rotating the cutter bit and comprises a first hydraulic motor having a first output shaft. A second hydraulic motor is spaced below and laterally offset from the first hydraulic motor and has a second output shaft extending parallel to the first output shaft. A driven gear is mounted at the end of each output shaft. A drive transmitting gear mechanism is meshingly engaged on opposite sides by the driven gears. A first conduit supplies pressurized hydraulic fluid to the first and second motors. A second conduit conducts hydraulic fluid from the first and second motors. A power transmitting mechanism operably connects the drive transmitting gear to the cutter bit to rotate the latter.

THE DRAWING

The objects and advantages of the invention will become apparent from the following detailed description of a preferred embodiment thereof in connection with the accompanying drawings in which like numerals designate like elements, and in which:

FIGS. 2 and 3 are fragmentary views depicting the drilling head in different modes of step-down advancement.

Figure 4A:
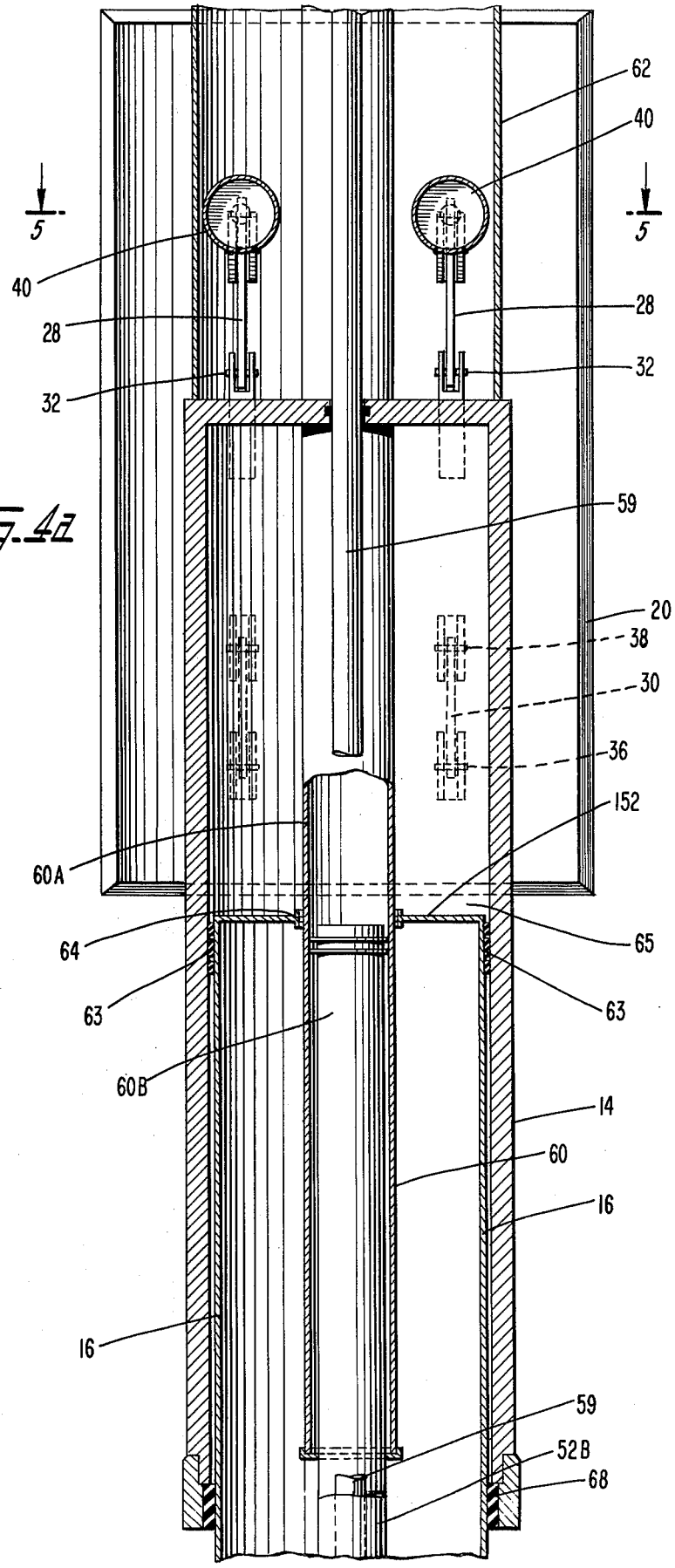

FIG. 4*a* is a vertical section through an upper portion of the drilling head;

FIG. 4*b* is a vertical section through the upper portion of the drilling head on an angle of ninety degrees relative to that of FIG. 4*a;*

Figure 4C:
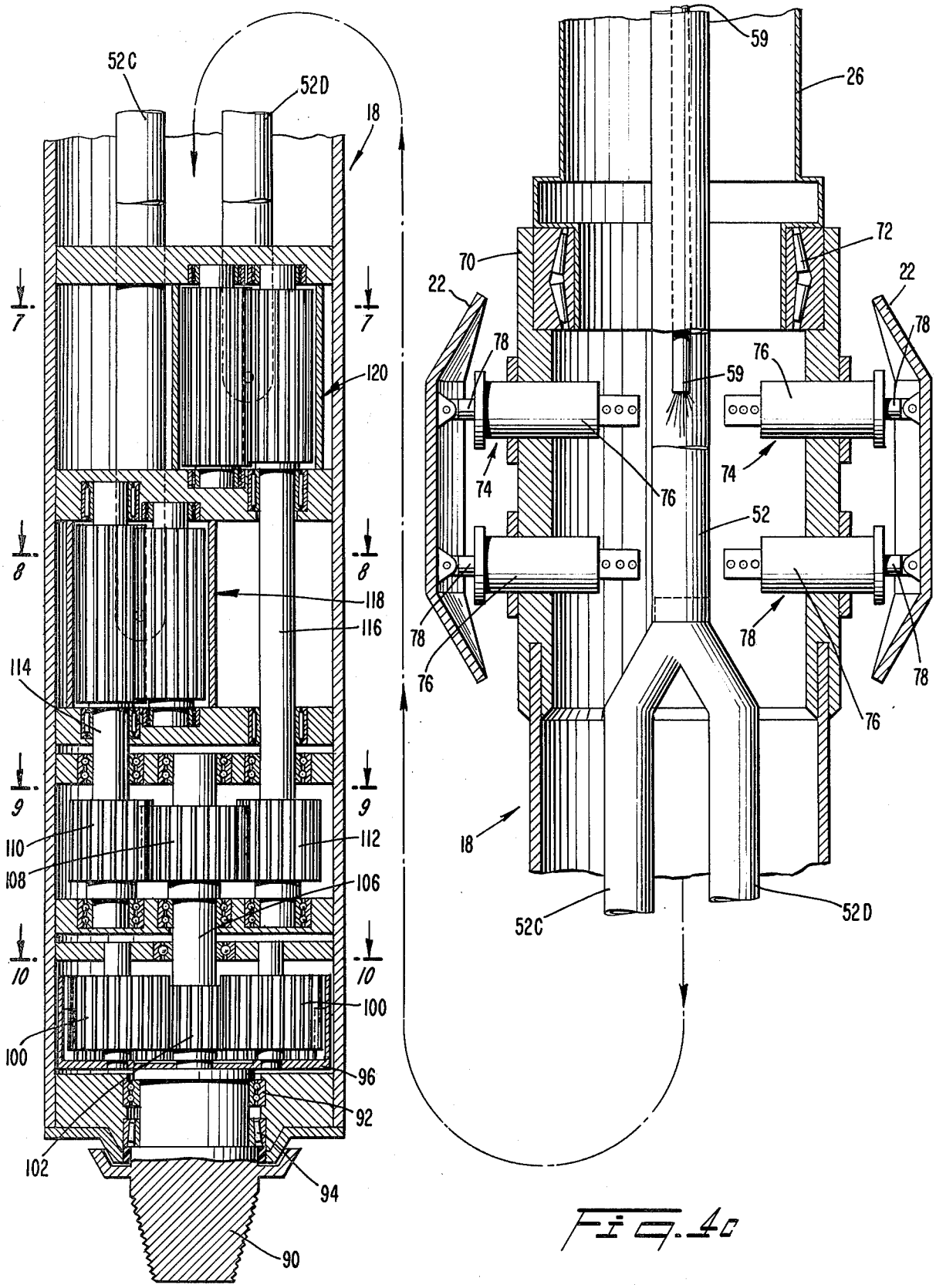
Figure 5:
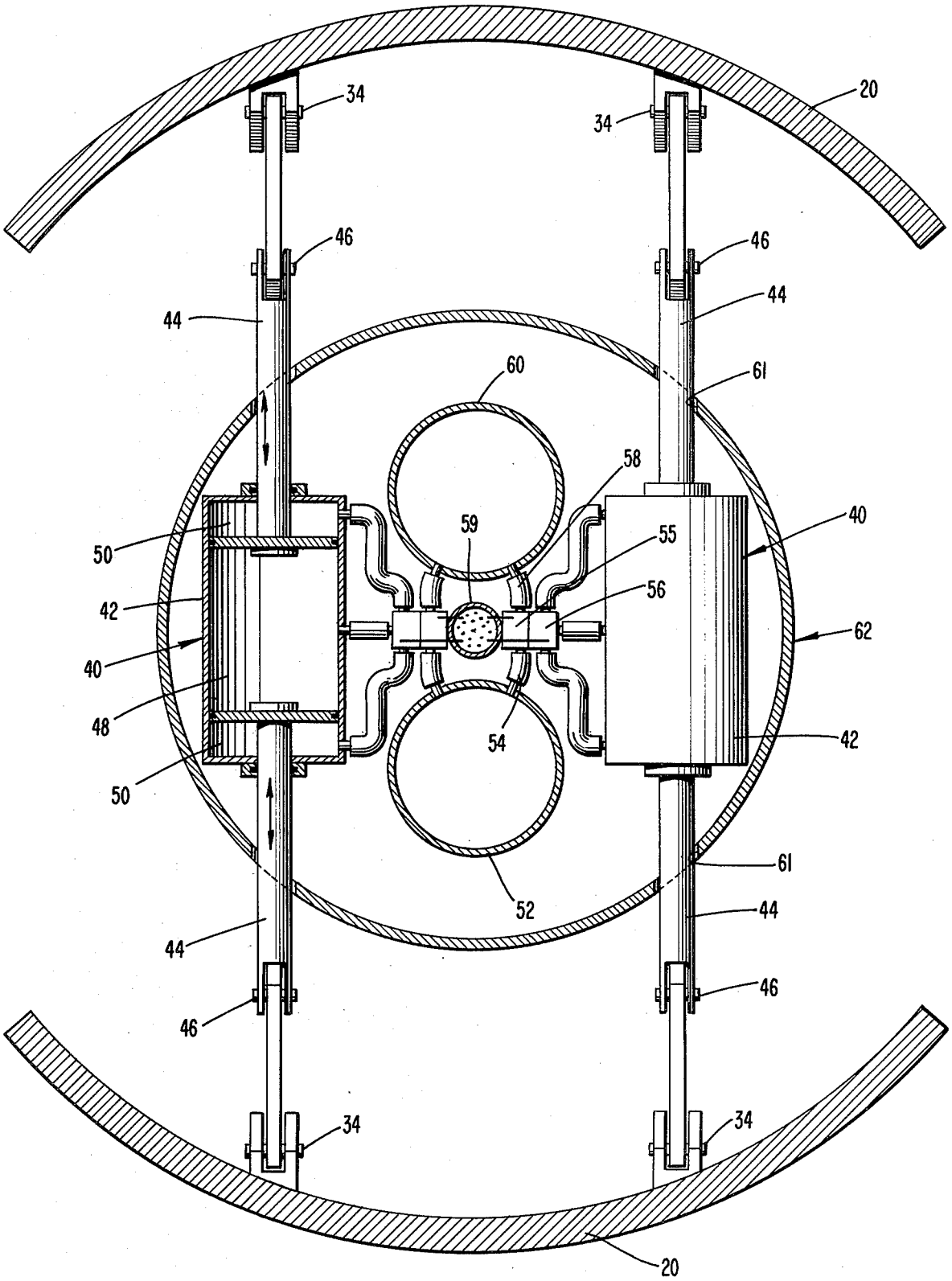

FIG. 4*c* is a vertical sectional view through a lower portion of the drilling head;

FIG. 5 is a cross-sectional view taken along line 5—5 in FIG. 4*a;*

Figure 6:
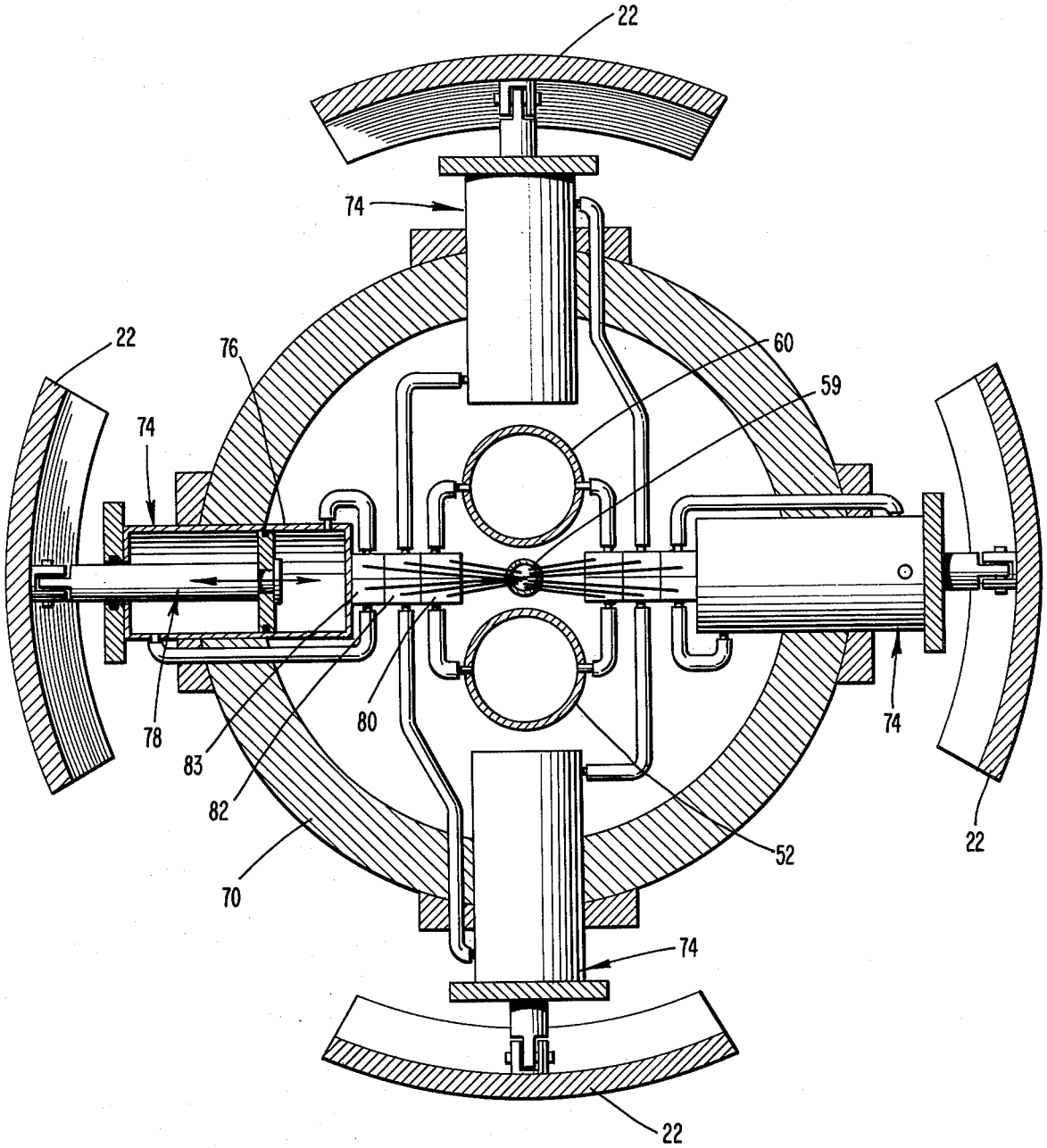

FIG. 6 is a cross-sectional view taken along line 6—6 of FIG. 4*c;*

Figure 7:
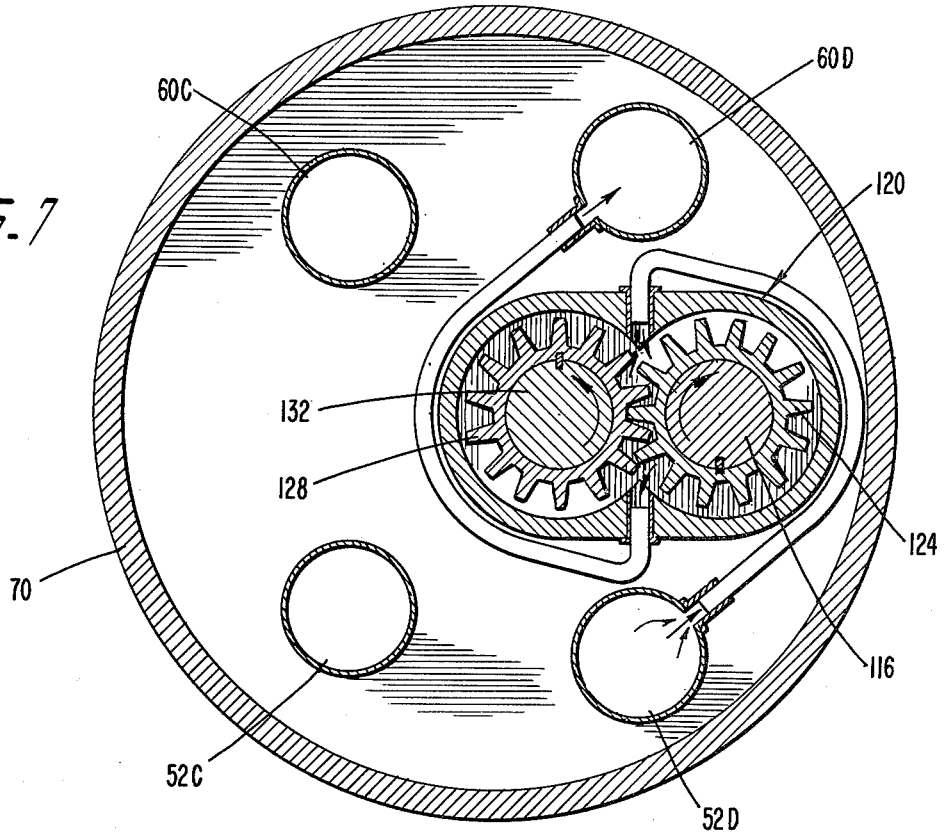
Figure 8:
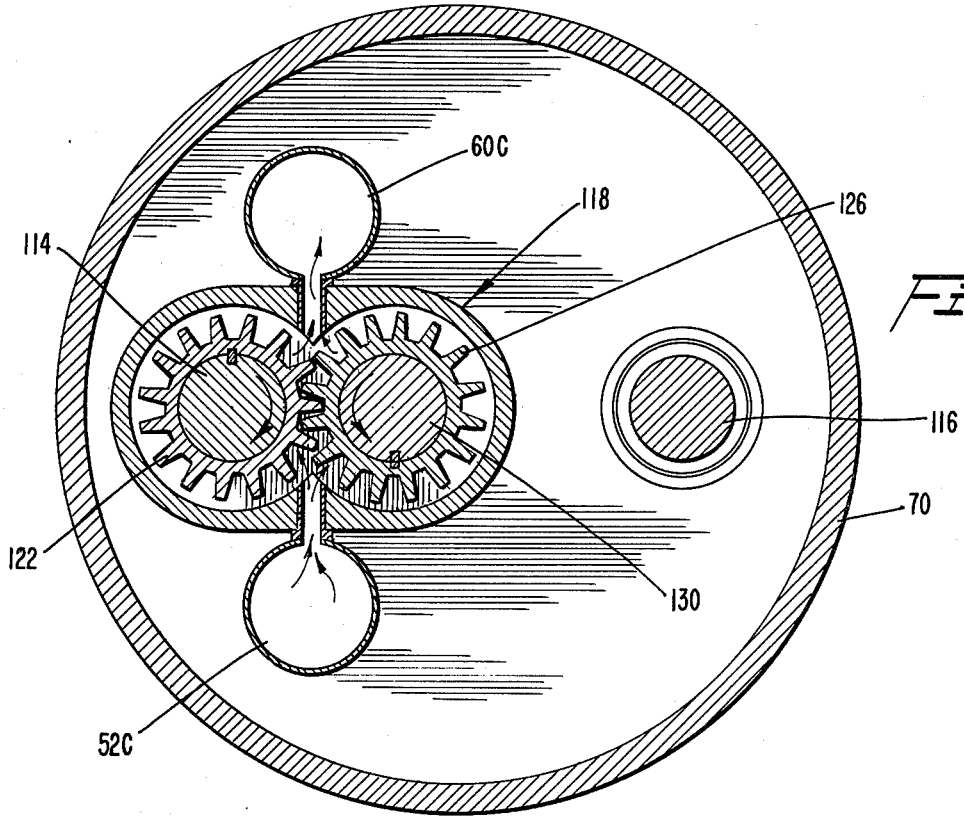
Figure 9:
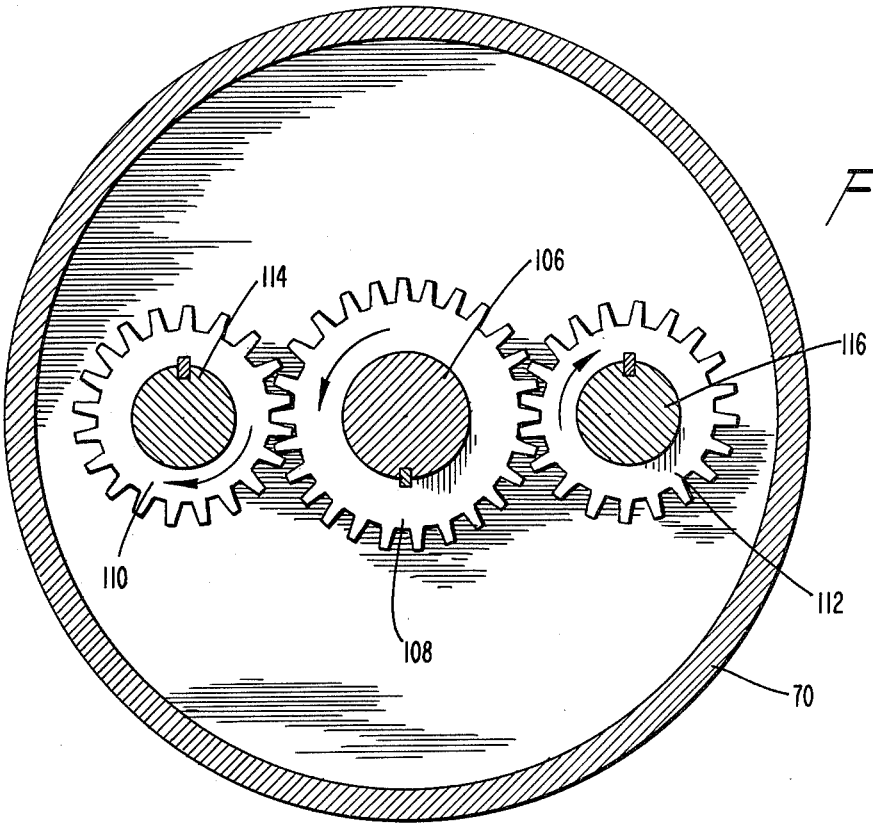
Figure 10:
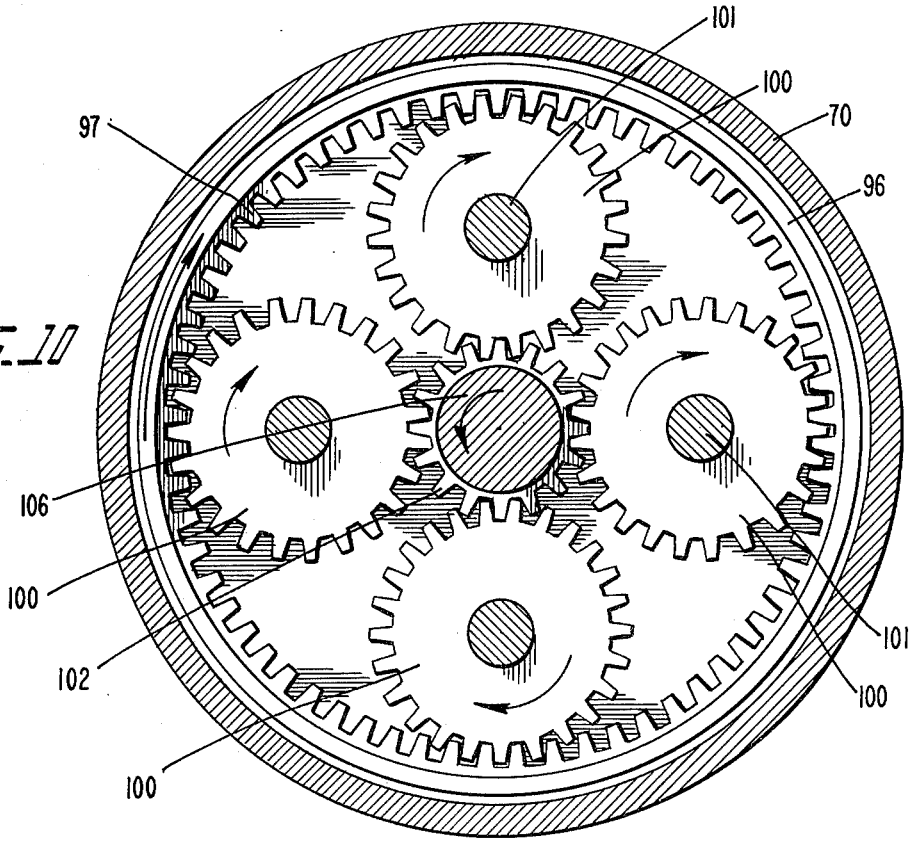

FIG. 7 is a cross-sectional view taken alone line 7—7 of FIG. 4c;

FIG. 8 is a cross-sectional view taken along line 8—8 of FIG. 4c;

FIG. 9 is a cross-sectional view taken along line 9—9 of FIG. 4c;

FIG. 10 is a cross-sectional view taken along line 10—10 of FIG. 4c; and

Figure 11:
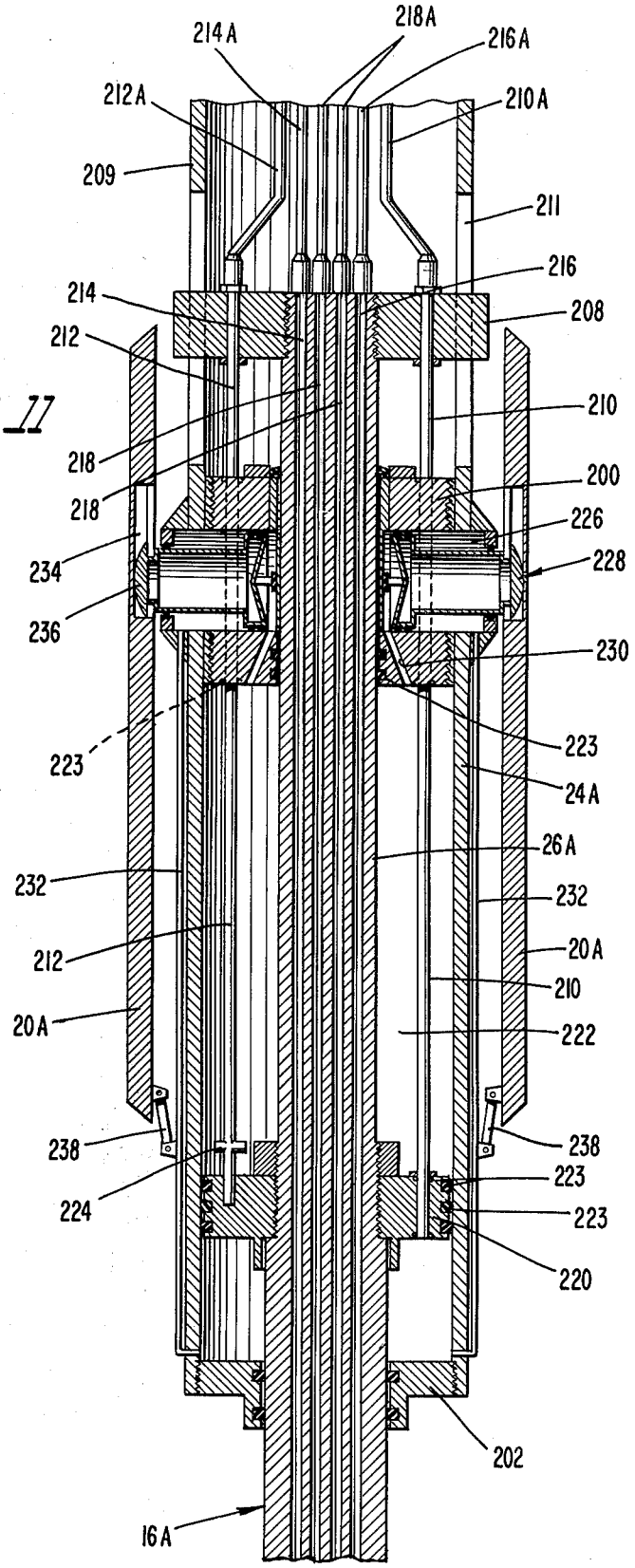

FIG. 11 is a longitudinal sectional view of a modified embodiment of the invention.

DETAILED DESCRIPTION OF A PREFERRED EMBODIMENT OF THE INVENTION

Figure 1:
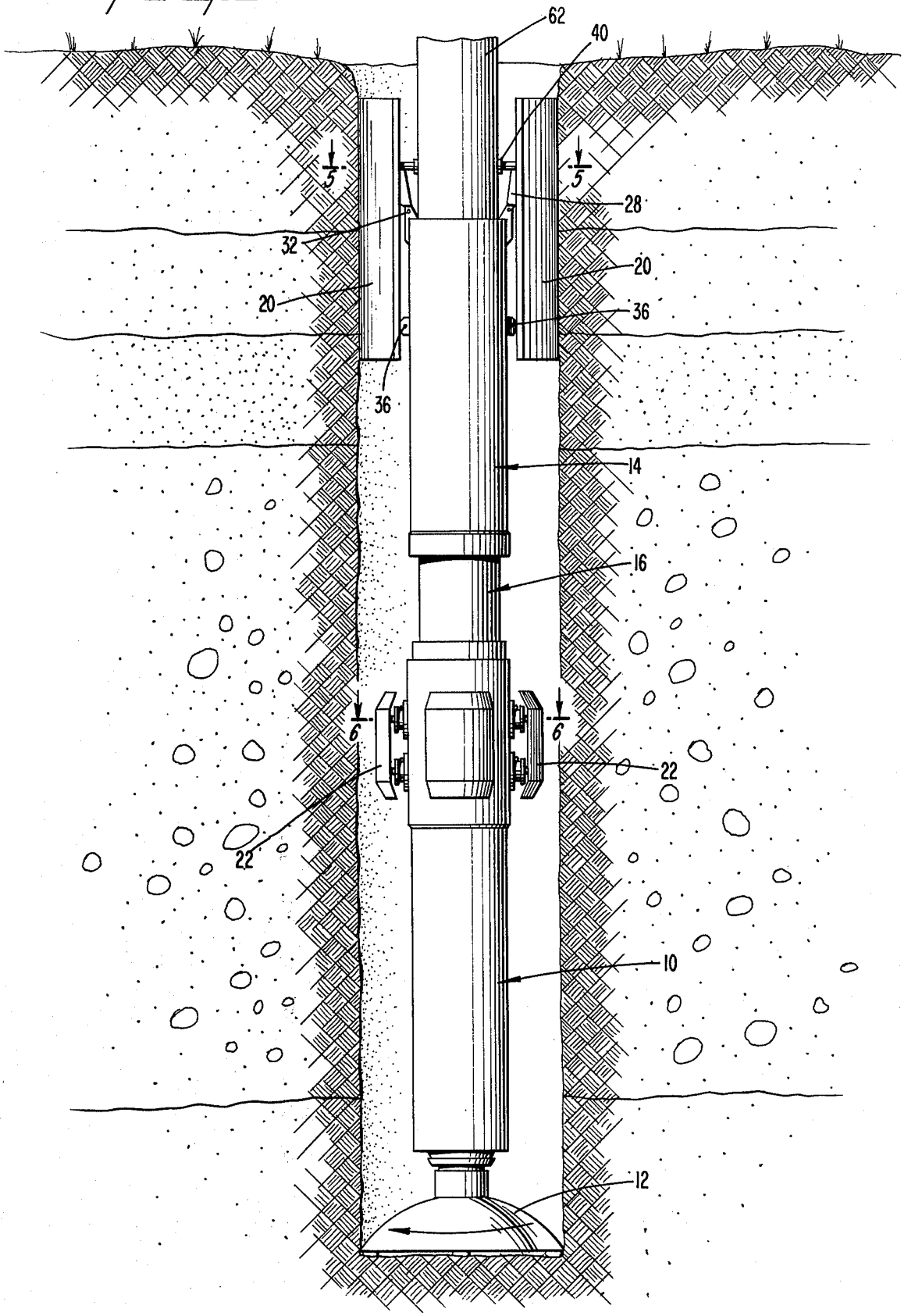
FIG. 1 is a side elevational view of a self-propelled drilling head according to the present invention as it advances downwardly through a formation.

In FIG. 1 there is depicted a self-propelled cutter head 10 according to the present invention as it penetrates downwardly through a formation by means of a suitable cutter bit 12 carried at a lower end of the head 10.

The head 10 includes a base section 14, and a drilling section 16 telescopingly carried by the base section for reciprocation relative thereto under the influence of a reciprocating fluid motor. A fluid-actuated drive mechanism 18 (FIG. 4c) is carried by the drilling section for rotating the drill bit 12. The base and drilling sections 14, 16 carry laterally extensible/retractible, vertically elongate shoes 20, 22 which when extended grip the wall of the hole being drilled. When the shoes of either of the sections 14, 16 are extended against the wall, the shoes of the other section are retracted, whereby the latter section is free to travel relative to the former section. In this way, the head is able to "walk" down the formation.

The base section 14 comprises an outer-cylindrical housing 24, the lower end of which is open to receive the upper end 26 of the drilling section 16. Mounted on the housing 24 are the extendible/retractible shoes 20. Preferably, there are two arc-shaped shoes 20, each being mounted by pairs of upper and lower links 28, 30 (FIG. 4b). The upper links 28 are of triangular shape and are each pivotably connected at 32 to a bracket on the housing 24 and at 34 to a bracket on the shoe 20. The lower links 30 are pivotably connected at 36 to a bracket on the housing and at 38 to a bracket on the shoe 20. The links 28, 30 function as a parallelogram linkage which is actuated by hydraulic rams 40. Each hydraulic ram 40 (FIG. 5) comprises a cylinder 42 and a pair of reciprocable piston/rod assemblies 44. The outer ends of the rods are pivotably connected at 46 to the upper links 28 and are operable to extend the shoes outwardly against the formation when the center or piston section 48 of the ram chamber is pressurized, and retract the shoes away from the formation when the end or rod sections 50 of the ram chamber are pressurized. Since each ram 40 is mounted to the base section only by virtue of its rod ends being connected to the links 28, the ram is adapted to rise and fall as the link 28 is swung inwardly and outwardly, i.e., the ram adapts to the level of the pivots 46.

Pressurized fluid for actuating the rams 40 is delivered by a pressurized fluid conduit 52 which communicates with the rams 40 by inlet lines 54 and valves 55, 56. Return fluid is conducted through the valves 55, 56, outlet lines 58 and a fluid return conduit 60. The valves 55, 56 are conventional electrical solenoid actuated valves which are powered by electrical connection with at least one electrical conductor 59. The conduits 52, 60 and the conductor 59 pass completely through the housing 24 and extend into the drilling section 16.

Connected to the top of the housing 24 is a tubular drill crown 62 which is preferably formed of braided metal strands and which surrounds the conduits 52, 60 and the conductor 59. Cables (not shown) are connected to the top of the drill crown to support the tool and enable recovery thereof at the end of a drilling operation. Slots 61 are formed in the drill crown through the rams 40 project.

The upper end 26 of the drilling section is slidable within the housing 24 and carries outer seals 63 and inner seals 64. There is thus defined a chamber 65 above a top wall 66 of the drilling section 16 into which pressurized fluid may be introduced in order to impart a downward thrust to the drilling section 16. The upper portion 26 of the latter thus defines a piston against which the pressurized fluid acts. Pressurized fluid is introduced into the chamber 65 through an inlet valve 67 communicating with the fluid supply conduit 52. The base section 14 is permitted to descend by gravity by communicating the chamber 65 with the fluid return conduit 60 via an exhaust valve 68. Electric power for actuating the valves 65, 66 is supplied by the conductor 59. If desired, the upper portion 26 of the drilling section 16 can be formed as a two-way piston so that the base section 14 would be pulled downwardly.

The upper end 26 of the drilling section is rotatably mounted in a cylindrical casing 70 of the drilling section by means of a rotary thrust and self-aligning bearing 72 (FIG. 4c). Mounted on the casing 70 are four pairs of vertically spaced hydraulic rams 74 which each include a cylinder 76 and piston/rod assemblies 78. Four lower shoes 22 are carried at the outer ends of the piston/rod assemblies (FIG. 6).

Pressurized fluid for actuating the rams 74 is supplied by the fluid delivery conduit 52 which communicates with a series of electrical solenoid-actuated valves 80, 82, 83. The valves are connected to the conductor 59 and are actuable to cause simultaneous extension or retraction of the lower shoes 22.

Disposed beneath the rams 74 is the drive mechanism 18 for the cutter bit 12. The drive mechanism comprises a drill bit hub 90 which projects from the drilling section 16 and has external screw threads for threadedly connecting to the cutter bit. The drill bit hub 90 is rotatably mounted in rotary and thrust bearings 92, 94 carried by the casing 70.

Extending upwardly from the drive shaft and connected for rotation therewith is a ring gear 96 (FIGS. 4c, 10). The ring gear has internal teeth 97 meshing with four secondary drive gears 100, the latter being carried out on vertical rotary axles 101.

A primary drive gear 102 meshes centrally with the secondary drive gears 100 and is mounted on a vertical shaft 106. The primary and secondary gears are thus arranged in sun-planet relationship. The shaft 106 carries a pinion gear 108 above the main drive gear 104. Opposite sides of the pinion gear 108 mesh with a pair of driven gears 110, 112, the latter being fixed at the ends of laterally spaced vertical output shafts 114, 116 of a pair of laterally and vertically spaced hydraulic fluid motors 118, 120 disposed in laterally overlapping relationship (FIGS. 4c, 7, 8).

Each motor 118, 120 comprises a conventional hydraulic motor containing intermeshing toothed wheels 122, 124 disposed within a chamber 126. Pressurized fluid is supplied to the chamber from a branch 52C, 52D of the fluid delivery conduit and removed therefrom through a branch 60C, 60D of the fluid return conduit.

The pressurized fluid drives wheels 122, 124 of the motors 118, 120, thereby turning the output shafts 114, 116 which are fixedly connected thereto. The other wheels 126, 128 are connected to idler shafts 130, 132.

It will be appreciated that the driven gears 110, 112 engage opposite sides of the pinion 108 and thus provide an efficient balanced application of force thereto. The hydraulic motors 118, 120 are relatively compactly arranged and yet in combination represents a powerful source of energy. The motors are spaced and staggered and are thus adaptable to slim profiles of the drilling head.

Power is transmitted by the pinion gear 108 to the primary drive gear 104 by the shaft 106, and by the primary drive gear to the secondary drive gears 100. The secondary drive gears rotate the ring gear 96 which, in turn, drives the cutter bit hub 90. Accordingly, the driven cutter bit chips away the formation as the drilling section 16 is pushed downwardly relative to the base section 14, the latter being held against stationary by the upper shoes 20. At the end of a cutting stroke of the drilling head, the upper shoes 20 are retracted and the lower shoes 22 are extended (if necessary) to enable the base section to descend by gravity relative to the drilling section.

In order to adapt the hydraulic supply and return conduits and the electric conductor 59 to the telescoping action of the base and drilling sections 14, 16, those conduits and conductor are rendered extensible and retractible within the drilling head by an arrangement comprising telescoping tubes. That is, the hydraulic supply conduit 52 comprises upper and lower telescoping tubes 52A, 52B (FIG. 4*b*), the latter being telescopingly received within the former. Seal rings 160 form a seal between the segments 52A, 52B to assure that all fluid is constrained to flow from the upper tube 52A into the lower tube 52B. The hydraulic return conduit 60 is similarly defined by telescoping tubes 60A, 60B. The conductor 59 includes a slip ring assembly 162 which enables portions 164, 166 of the conductor 59 to slide relative to one another while maintaining a continuous electrical supply. Thus, as the base and drill sections 14, 16 travel relative to one another, the tubes 52A, B and the conductor portions 164, 166 telescope relative to one another to automatically adjust to a proper length.

In operation, the drilling head performs a drilling stroke while the upper shoes 20 are extended against the wall of the hole and the lower shoes 22 are retracted (FIG. 3). During this stroke, pressurized hydraulic fluid is introduced into the chamber 65 in order to continuously urge the drilling section 16 downwardly relative to the base section 14. The formation is chipped away by the cutter bit 12 which is driven by the hydraulic motors 118, 120. Pressurized fluid is delivered to those motors from the fluid supply conduit 52 and is removed by the fluid return conduit 60 (FIGS. 7, 8). The parallel output shafts 114, 116 power the driven gears 110, 112 which drive opposite ends of the pinion 108. Motion is transmitted by the pinion 108 to the sun or primary drive gear 104 through the spindle 106. The primary drive gear drives the planet or secondary drive gears 100. The latter rotates the ring gear 96 which powers the cutter bit shaft 90.

At the end of a drilling stroke, when the drilling section 16 lies fully extended, the upper shoes 20 are retracted and, if desired, the lower shoes 22 are extended (FIG. 2). Then, the chamber 65 is communicated with the fluid return conduit 60, allowing the base section 14 to gravitate downwardly relative to the drilling section 16. Accordingly, the drilling head is positioned for a subsequent drilling stroke.

During relative movement between the base and drilling sections 14, 16, the telescopic tubes 52A, 52B and 60A, 60B of the fluid supply and return conduits extend and retract to automatically adjust to the proper length.

Drilling mud for the removal of cuttings can be supplied by a suitable conduit disposed externally of the drilling head and attached thereto. The drilling mud would be circulated upwardly through the annulus in a conventional manner.

It will be appreciated that the hydraulic conduits are to be payed-out from a conventional apparatus at the surface. The conduits, which are flexible, are reel-mounted and are gradually payed-out while simultaneously conducting pressurized fluid.

MODIFICATION

In lieu of providing a telescoping arrangement for the fluid and electrical supply conduits, a modified embodiment can be employed as depicted in FIG. 11. In that embodiment, a cylindrical housing 24A includes upper and lower end walls 200, 202 which are threadedly connected to the upper and lower ends of the housing 24A. Slidably mounted within the end walls 200, 202 is an upper end 26A of a drilling section 16A which is similar to that disclosed in connection with the earlier figures.

The housing 24A is suspended by means of a cylindrical crown 209 which may be formed of braided metallic strands.

Mounted on the upper end 26 of the drilling section is a ring 208 through which extend the upper ends of hydraulic conduits 210, 212, 214, 216 and one or more electrical cables 218. These conduits and cables are slidable within the upper end wall 200 and interconnect with the lower ends of corresponding flexible conduits and cables 210A, 212A, 214A, 216A, 218A which extend to the ground surface. The ring 208 is slidably mounted within a slot 211 in the crown 209; this prevents rotation of the upper end of the drilling section 16A.

Also mounted on the upper end 26A of the drilling section 16A is a piston 220. The piston 220 is slidable within a chamber 222 defined by the cylindrical housing 24A and the end walls 200, 202. The upper and lower end walls are suitably provided with seals 223 to assure that the chamber 222 is leak-proof. The lower end of the conduit 210 extends completely through the piston 220 and communicates with the chamber 222 beneath the piston 220. The lower end of the hydraulic conduit 212 includes an outlet 224 communicating with the chamber 222 above the piston.

Provided in the upper end wall 200 are a plurality of bores 226 in which rams 228 are slidably mounted. Inner ends of the bores 226 communicate with the portion of the chamber 222 disposed above the piston 220, by passages 230. Conduits 232 communicate outer ends of the bores 226 with the portion of the chamber 222 disposed below the piston 220.

Connected to outer ends of the rams 228 are arc-shaped shoes 20A. The shoes contain slots 234 within which enlarged heads 236 of the pistons slide. The lower ends of the shoes are connected to the housing 24A by means of links 238. When the rams 228 are extended, the shoes 20A are extended, the heads 236 sliding within the slots 234.

In operation, pressurized hydraulic fluid conducted through the conduit 212 communicates with the chamber 222 above the piston 220 and simultaneously communicates with the rams 228 via passages 230. Since the outward extension of the shoes 20A offers less resistance than the downward thrust of the piston 220 (the latter serving to push the cutter bit into the formation), the shoes 20A will be extended to grip the side of the formation. Thereafter, the piston 220 will be forced downwardly during a cutting stroke. As the piston 220 and rams 228 are displaced, hydraulic fluid is exhausted via the passages 232 and the conduit 210. As the piston 220 travels downwardly, the ring 208 slides within the slot 250 in the crown 209. Simultaneously, the hydraulic conduits 210A, 212A, 214A, 216A, 218A are payed-out from the surface. Hydraulic flow is reversed when it is desired to retract the pistons and lower the housing 24A.

It will be appreciated that the present invention provides a self-propelled drilling head which exhibits ample power and yet can be formed of slim profile due to the spaced and staggered arrangement of plural hydraulic drive motors. The output shafts of the motors power opposite sides of a pinion gear to effect a highly efficient and balanced transfer of power from the drive mechanism. The arrangement of sun and planet gears which drive a ring gear assures a smooth and effective transfer of power to the cutter bit. The use of telescoping fluid conduits and electrical conductor minimizes space while presenting minimum chance that such elements will be fouled as the step-down mechanism operates. All components of the drilling head are protected within closed housings, and the fluid conduits and electrical connector are shielded within the support cable.

Although the invention has been described in connection with a preferred embodiment thereof, it will be appreciated by those skilled in the art, that additions, modifications, substitutions and deletions not specifically described, may be made without departing from the spirit or scope of the invention as defined in the appended claims.

What is claimed is:

1. A self-propelled vertical downhole drilling head comprising:

a base section including gripper means mounted for longitudinally directed extension and retraction to selectively grip the wall of a hole being drilled, first actuating means for extending and retracting said gripper means, a drilling section mounted on said base for reciprocation relative thereto, second actuating means for urging said drilling section downwardly relative to said base section when said gripper means is extended, a cutter bit mounted at a lower end of said drilling section, and third actuating means for rotating said cutter bit, comprising:

a first hydraulic motor having a first output shaft, a second hydraulic motor spaced longitudinally and laterally from said first hydraulic motor and having a second output shaft extending parallel to said first output shaft, a driven gear mounted at the end of each said output shaft, drive transmitting gear means meshingly engaged on opposite sides by said driven gears, first conduit means for supplying pressurized hydraulic fluid to said first and second motors, second conduit means for conducting hydraulic fluid from said first and second motors, and power transmitting means operably connecting said drive transmitting gear to said cutter bit to rotate the latter.

2. Apparatus according to claim 1, wherein said drilling section includes second gripper means mounted for extension and retraction to selectively grip the wall of the hole being drilled, and fourth actuating means for extending and retracting said second gripper means.

3. Apparatus according to claim 1, wherein said drive transmitting gear means comprises a pinion gear mounted on a spindle, said power transmitting means comprising a primary drive gear mounted on said spindle below said pinion gear, a plurality of secondary drive gears meshing with said primary drive gear and with a ring gear surrounding said secondary drive gears, and a hub connected to said ring gear and said cutter bit, the latter being coaxial with said ring gear.

4. Apparatus according to claim 1, wherein each hydraulic motor includes first and second toothed wheels driven by pressurized hydraulic fluid from said first conduit means, one of said toothed wheels connected to a respective one of said output shafts and the other wheel connected to an idler shaft.

5. Apparatus according to claim 4, wherein said first, second, and third actuating means comprise hydraulically actuated motors which are fluidly connected to said first conduit means.

6. Apparatus according to claim 1, wherein said gripper means comprises a plurality of vertically elongate gripper shoes each mounted by vertically spaced generally parallel links, said first actuating means being connected to upper ones of said links.

7. Apparatus according to claim 1, wherein said first and second conduit means each comprise telescoping tubes, one of said tubes mounted in said base section and the other tube mounted in said drilling section, enabling said conduits to extend and retract in response to relative telescopic movement between said base and drilling sections.

8. Apparatus according to claim 1, wherein said first and second actuating means are hydraulically actuated and include hydraulic lines connected to said first and second conduit means, electrically actuated valves in said hydraulic lines for controlling the direction of hydraulic fluid travel, and electrical conductor means extending from the ground surface to the drilling head for supplying electrical power to said valves.

9. Apparatus according to claim 1, wherein said electrical conductor means comprises first and second telescoping sections which enable said conductor to extend and retract in response to relative telescopic movement between said base and drilling sections.

10. Apparatus according to claim 1, wherein said drilling section includes an upper end telescopingly received within a housing of said base section, said housing and upper end of said drilling section forming a chamber for receiving pressurized fluid to forcefully extend said drilling section downwardly from said base section.

11. Apparatus according to claim 1, wherein said first actuating means comprises hydraulic ram means connected to said gripper means; said base including end walls confining a chamber therebetween, said second actuating means includes a piston connected to said drilling section and slidable within said chamber; hydraulic conduits connected to said piston to communicate with said chamber on opposite sides of said piston to reciprocate the latter, said hydraulic conduits being slidable within an upper one of said end walls.

12. Apparatus according to claim 11, wherein said rams include passages communicating with said chamber above said piston to extend said gripper means when said chamber above said piston is pressurized.

13. A self-propelled drilling head comprising:

a base section and a drilling section telescopingly coupled for relative longitudinal reciprocation, one of said base and drilling sections forming a fluid piston reciprocably mounted within a chamber of the other of said sections, said base and drilling sections each including extendible and retractible shoes for gripping the wall of the hole being drilled, and hydraulic actuators for extending and retracting said shoes, said drilling section carrying a cutter bit at its lower end, a hydraulic supply conduit for delivering pressurized hydraulic fluid to said chamber and said actuators, said supply conduit comprising telescoping tubes mounted on said base and driling sections, respectively, which tubes telescopically extend and retract in response to relative telescopic movement between said base and drilling sections, electrically actuated valves for controlling the delivery of pressurized fluid to said chamber and actuators, and two hydraulic motors mounted in vertically spaced and laterally offset relationship in said drilling section, said motors being connected to said hydraulic supply conduit and including parallel, laterally spaced output shafts operably connected to said cutter bit.

14. Apparatus according to claim 1, wherein said first and second motors are disposed in laterally overlapping relationship.

15. Apparatus according to claim 13, wherein said laterally overset motors are disposed in laterally overlapping relationship.

16. Apparatus according to claim 1 including electrically actuated valves for controlling the delivery of pressurized fluid to said first and second actuating means.

* * * * *